US005618223A

United States Patent [19]

Masuno et al.

[11] Patent Number: 5,618,223

[45] Date of Patent: Apr. 8, 1997

[54] METHOD AND APPARATUS FOR RECYCLING SAND

[75] Inventors: Osamu Masuno, Kuwana; Kazuharu Matsui, Toyokawa; Takehiko Matsumoto, Sinshiro, all of Japan

[73] Assignee: Sintokogio, Ltd., Nagoya, Japan

[21] Appl. No.: 369,076

[22] Filed: Jan. 5, 1995

[30] Foreign Application Priority Data

| | | | |
|---|---|---|---|
| Jan. 7, 1994 | [JP] | Japan | 6-012157 |
| Jan. 7, 1994 | [JP] | Japan | 6-012158 |
| May 27, 1994 | [JP] | Japan | 6-138010 |
| May 27, 1994 | [JP] | Japan | 6-138011 |

[51] Int. Cl.[6] ..... B24B 31/00

[52] U.S. Cl. ..... 451/103; 451/111; 451/28; 241/278.1; 241/DIG. 10; 164/5

[58] Field of Search ..... 451/56, 58, 28, 451/103, 111, 278, 283, 259, 87, 88, 104, 96, 97, 98; 241/278.1, 601, DIG. 10; 164/5

[56] References Cited

U.S. PATENT DOCUMENTS

| | | | |
|---|---|---|---|
| 1,050,122 | 1/1913 | Gare | 241/278.1 |
| 2,620,138 | 12/1952 | Vazieux et al. | 241/278.1 |
| 2,962,234 | 11/1960 | Avila | 241/278.1 |
| 3,236,743 | 2/1966 | Pierson | 241/278.1 |
| 3,401,489 | 10/1968 | Wern | 451/97 |
| 3,982,702 | 9/1976 | Barnhart et al. | 241/278.1 |
| 4,542,857 | 9/1985 | Akasaka | 241/278.1 |

*Primary Examiner*—James G. Smith
*Assistant Examiner*—Dona C. Edwards
*Attorney, Agent, or Firm*—Limbach & Limbach

[57] ABSTRACT

An apparatus to remove adhering material from the surfaces of sand to recycle the sand is disclosed. The apparatus includes a container (13) to hold sand (S) to be processed, the container having a bottom opening; pressing means (17–20) to press the sand in the container downwards; a rotor (10) disposed under the bottom opening of the container (13), the rotor (10) having a surface (11) that contacts the sand in the container; means (2) for driving the rotor (10); and a gap (G) disposed near a place between the container and the rotor. The sand contacts and is abraded by the rotary surface (11 ) of the rotor (10), and the processed sand is discharged by the centrifugal force of the rotor (10) from the gap (G) onto a chute (21).

12 Claims, 7 Drawing Sheets

METHOD AND APPARATUS FOR RECYCLING SAND

BACKGROUND OF THE INVENTION

1. Field of the Invention

This invention relates to a method and an apparatus for recycling sand by removing adhering material from sand surfaces, especially for recycling molding sand which has been used for molding a product.

2. Description of the Prior Art

A conventional apparatus that removes foreign material from sand surfaces to reuse molding sand is disclosed in Japanese Utility Model Publication No. 61-35323 (JP, Y, 61-35328). To reuse the sand this apparatus removes or separates foreign material from sand surfaces by feeding the used sand to an impeller to thereby throw it against a wall. However, since in this method the impact given to the sand is so strong, the sand tends to become fine or smaller. This causes a drawback in that the amount of necessary binding material to be added to the molding sand increases when it is reused.

The purpose of this invention is to provide a new apparatus for removing foreign material that adheres to sand surfaces while maintaining the original grain size of the sand.

SUMMARY OF THE INVENTION

The apparatus of this invention for removing adhering material from the surfaces of used sand to recycle it includes a container for retaining the sand to be processed, the container having a bottom opening; a member disposed under the container, the member having a surface that contacts the sand in the container; a gap or a slit disposed between the container and the member or disposed near a place between the container and the member; pressing means for pressing the sand in the container downwards; and means for rotating the container and the member relative to each other.

The used sand is pressed against the member by the pressing means while the member and the container are rotated relative to each other. Accordingly, the used sand is abraded by the member, thereby adhering foreign material being removed from the sand surfaces. The processed sand is discharged from the gap, or slit, for reuse.

Further details and the features and advantages of the invention will be explained by referring to the accompanying drawings.

DESCRIPTION OF THE PREFERRED EMBODIMENTS

Several preferred embodiments of the apparatus of the invention will now be explained. In them the same numerals are assigned to the same or similar elements.

Figure 1:
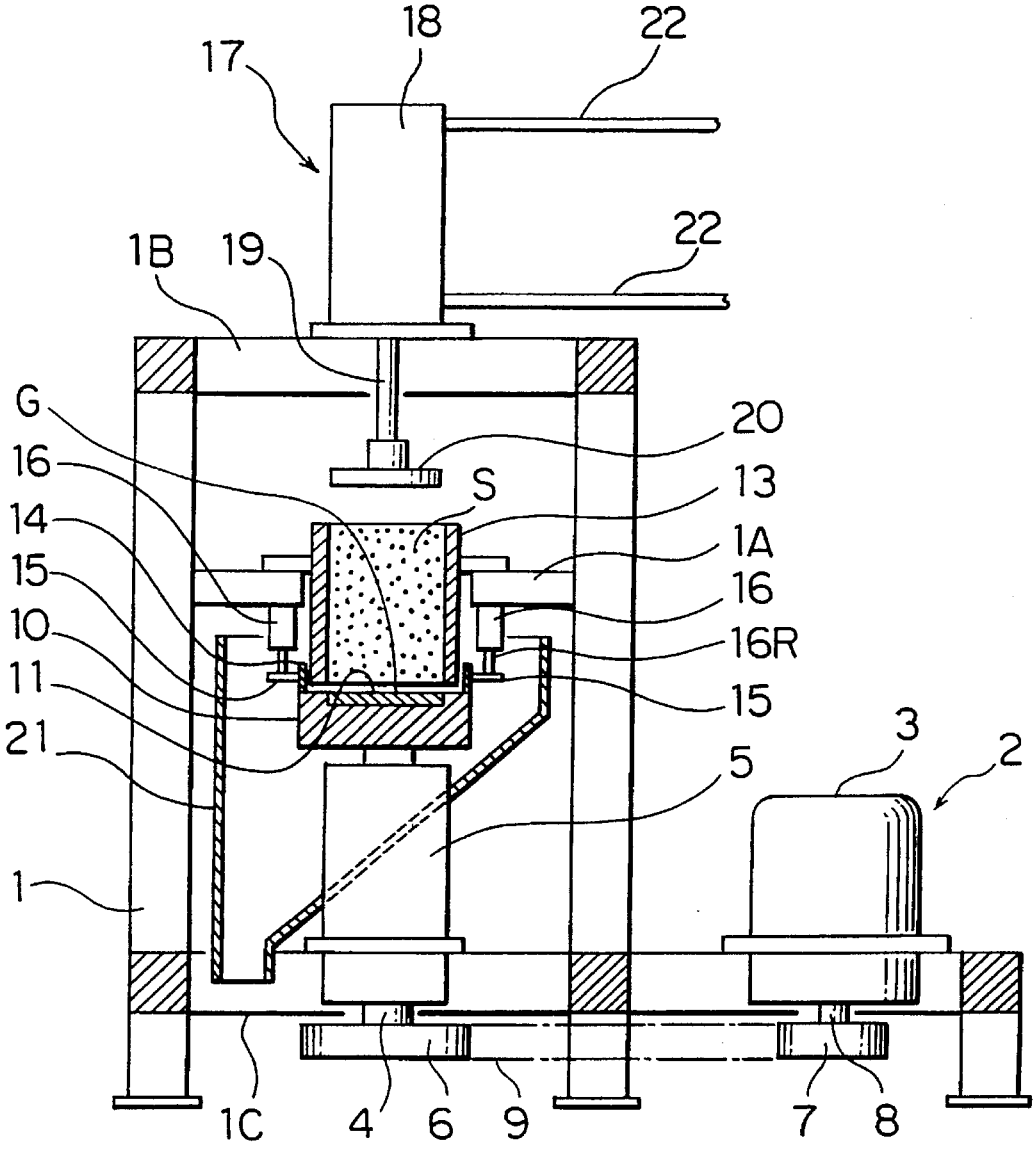
FIG. 1 is a partly sectional front view of a first embodiment of the apparatus of this invention.

With reference to FIGS. 1 to 4, a first embodiment of the apparatus of this invention will now be explained. In FIG. 1 a frame 1 is installed on the floor. It includes an intermediate frame 1A, an upper frame 1B, and a lower frame 1C.

Driving means 2 are mounted on the lower frame 1C. The means 2 includes a motor 3 mounted on the lower frame 1C and a rotary shaft 4 mounted in a bearing 5, which in turn is mounted on the lower frame 1C. Toothed pulleys 6 and 7 are respectively secured to the lower ends of the rotary shaft 4 and the output shaft 8 of the motor 3. A toothed belt 9 is wound around the pulleys 6 and 7 so that the drive power of the motor 3 is transmitted to the rotary shaft 4. A disk-shaped member or rotor 10 is fixedly mounted on a distal, or upper, end of the rotary shaft 4. The rotor 10 has a surface 11 which may be provided with abrasive material.

On the intermediate frame 1A a hollow-cylindrical container 13 for holding used sand is mounted so that the lower end of the container 13 is adjacent to the surface 11 of the rotor 10. Preferably, the container 13 and the rotor 10 are arranged in their fixed positions such that a gap, or slit, G of 0.1–0.5 mm is defined between the lower end of the container 13 and the upper surface 11 of the rotor 10. A stopper ring 14 is disposed around the cylindrical container 13 so that the ring can enclose the gap G under the container. The stopper ring 14 is supported via a plurality of arms attached to the piston rods 16R of a plurality of cylinders 16, which are suspended from the intermediate frame 1A. Thus, the ring 14 is vertically moved alongside the external surface of the container 13 so as to open or close the gap G.

On the upper frame 1B, pressing means 17 are mounted. The pressing means include a cylinder 18 provided with a piston rod 19, a circular pressing plate 20 attached to a distal, or lower end, of the piston rod 19, and hydraulic pipes 22, 22.

Figure 2:
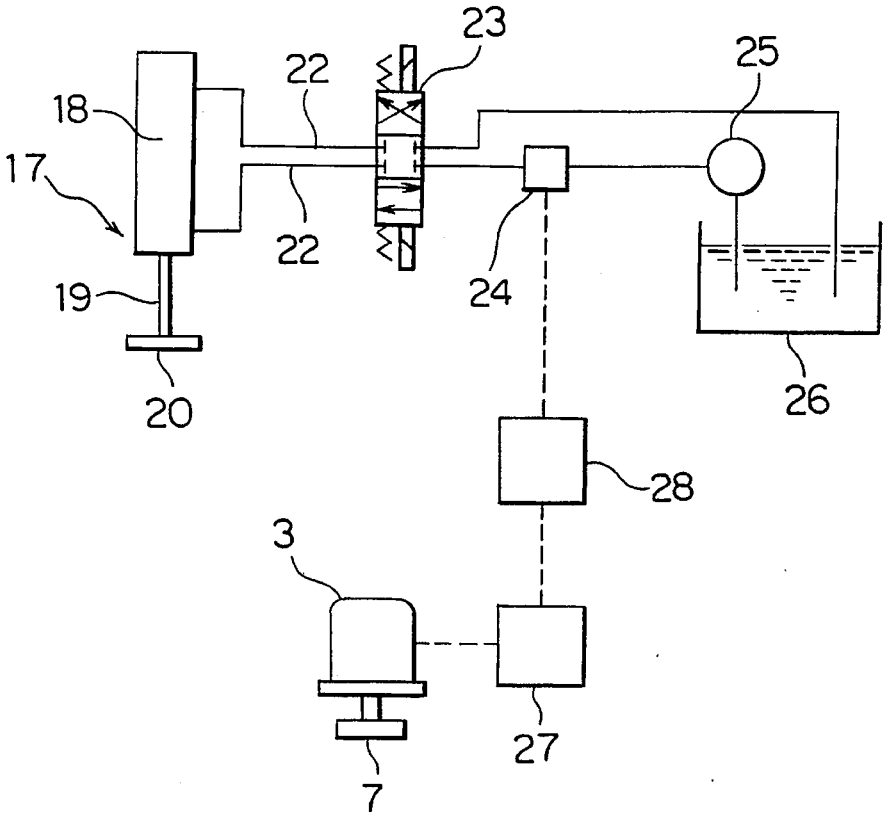
FIG. 2 is a diagram of a pressure control circuit used for the apparatus of FIG. 1.

With reference to FIG. 2, the hydraulic control for the pressing means 17 is now explained. The cylinder 18 is in communication with a pump 25 and an oil tank 26 through the pipes 22, 22, an electromagnetic directional control valve 23, and a pressure control valve 24. The pressure control valve 24 is designed to control the oil from the tank 26 at a pressure proportional to an output signal (which will be explained below) and to feed the oil into the cylinder 18.

The motor 3 is electrically coupled to a detector 27 that detects the value of the current or power of the motor 3. The detector 27 is electrically coupled to an input/output controller 28 which in turn is electrically coupled to the pressure control valve 24. The input/output controller 28 processes a signal, which corresponds to the detected value from the detector 27, as an input value, and sends an electrical output signal to the pressure control valve 24 so that the input value becomes equal to a constant predetermined value.

Figure 3:
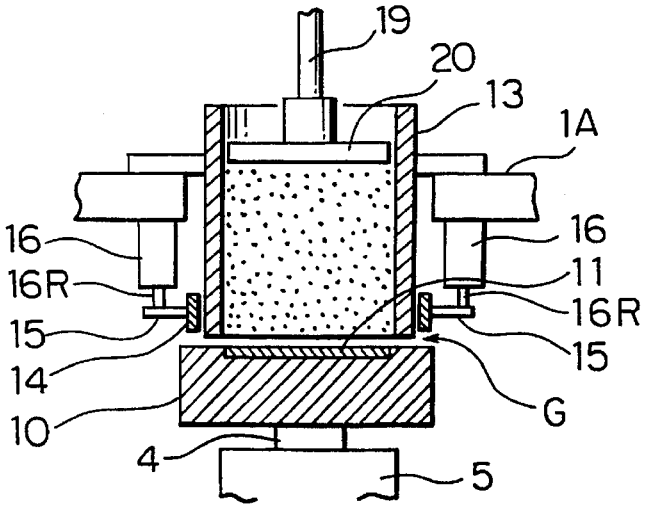
FIG. 3 is an enlarged view of a part of the apparatus of FIG. 1 in operation.

In the apparatus as configured as mentioned above the stopper ring 14 is in a lowered position to close the gap G, and the pressing plate 20 is in a raised position as shown in FIG. 1, when the motor 3 and the hydraulic pump 25 are activated. Used sand S to be processed is then fed into the container 13 from its upper opening in any known way. The state where sand S has filled in the container 13 is shown n FIG. 1. Then, the electromagnetic directional control valve 23 is controlled so as to lower the pressing plate 20 to press the used sand in the container against the surface 11 of the rotor 10. When the plate 20 contacts the upper surface of the used sand the cylinders 16, 16 are actuated to open the gap G. This state is shown in FIG. 3. Since the used sand is abraded by the rotating surface 11 under pressure, material adhering to the sand surfaces is effectively removed. Simultaneously the processed sand is discharged from the opened gap, by the centrifugal force of the rotor 10, onto a chute 21 (FIG. 1 ) disposed under the container 13.

This operation continues until the pressing plate 19 reaches a desired position which is above the lower end of the container 13, thereby leaving a small amount of the used sand remaining in the container. After the operation finishes, the stopper ring 15 is raised to its upper position, and the directional control valve 23 is controlled to raise the pressing plate 20 to its upper position so as to enable the next charge of used sand to be charged into the container 13.

Now, how to control the cylinder 18 will be explained. As by actuating the cylinder 18 the plate 20 is lowered from its upper position shown in FIG. 1 and pressed against the sand in the container 13 as shown in FIG. 3, resistance to the rotation of the rotor 10 is produced. Therefore, the rotor consumes power. The value of the power it consumes changes as the amount of the sand in the container decreases. This changeable value is detected by the detector 27 and a signal corresponding to the value is transmitted to the input/output controller 28. The input/output controller 28 compares the inputted signal with a predetermined power value for the motor 3 and then determines a desirable pressure of the cylinder 18 given to the pressing plate 20 so that the power of the motor 3 can be the predetermined power value. The controller then sends an electrical output signal to the pressure control valve 24 so as to keep the cylinder 18 at the desired pressure.

As is explained above, the input/output controller 28 controls the pressure of the cylinder 18 relative to the output signal. As a result, the pressure of the pressing plate 20 is controlled so that the driving power for the motor 3 can be constant. This control is continued until the plate 20 reaches the predetermined position above the lower end of the container 13.

Since the power for the motor 3 is kept constant, the motor is prevented from an overload. Further, since the pressing force of the plate 20 is kept constant, the sand is always uniformly processed.

Although in the above embodiment a hydraulic cylinder is used, alternatively a pneumatic cylinder may be used. As shown in FIG. 2, the pressure control valve 24 is attached to the hydraulic pipe 22. However, the valve 247 may be eliminated by incorporating in the pump 25 a controller to cause the pump 25 to feed oil at a desired pressure in response to an external signal.

Although in the above embodiment the power (kw) for the motor 3 is detected and the pressure of the oil is controlled so as to make the power of the motor constant, alternatively, the current (A) of the motor 3 may be made to be detected if the variation in the voltage for the motor is small.

In FIGS. 4–7 a second embodiment of the apparatus of this invention is shown. The apparatus of this embodiment differs from the first embodiment in the two following points.

The first difference is that the stopper ring 15 and its associated elements 16, 16A, 17 are not provided.

The second difference is that the rotor 10 has an internal void to hold used sand. The upper surface 11 of the sand in the rotor 10 corresponds to the surface 11 of the rotor of FIG. 1. In this embodiment the hollow-cylindrical rotor 10 is coaxial with the hollow-cylindrical container 13, and the internal and external diameters of the rotor 10 and the container 13 are substantially the same.

When the rotor 10 is driven and when the sand in the container 13 and the sand in the rotor 10 contact each other at the surface 11, the sand S, both in the container and the rotor, tends to move, slip, or rotate due to its frictional contact at the surface 11. Since this movement or slippage of the sand affects its stable processing, several sand-stopper members 41 and 42 are respectively disposed in the rotor 10 and the container 13. The stopper members 41, 42 are plates in the embodiment shown in the drawings. As will be clearly seen from FIGS. 4 and 5, the plate 41 is disposed diametrically in the rotor 10 so that the plate 41 divides the rotor into two halves. As will be clearly seen from FIGS. 4 and 6, four plates 42 are equidistantly fixed to the inner cylindrical wall of the lower part of the container 13. The plates 42 extend from their proximal ends, where they are fixed to the inner wall, towards the center of the lower circular part of the cylindrical container 13. The movement of the sand, both in the container and the rotor, can be prevented by these stopper members 41, 42.

The means of FIG. 2 for controlling the pressure of the plate 20 is also used in this embodiment. By activating the cylinder 18 the pressing plate 20 may be lowered from a position shown in FIG. 4 to a position near the upper ends of the stopper members 42.

Figure 4:
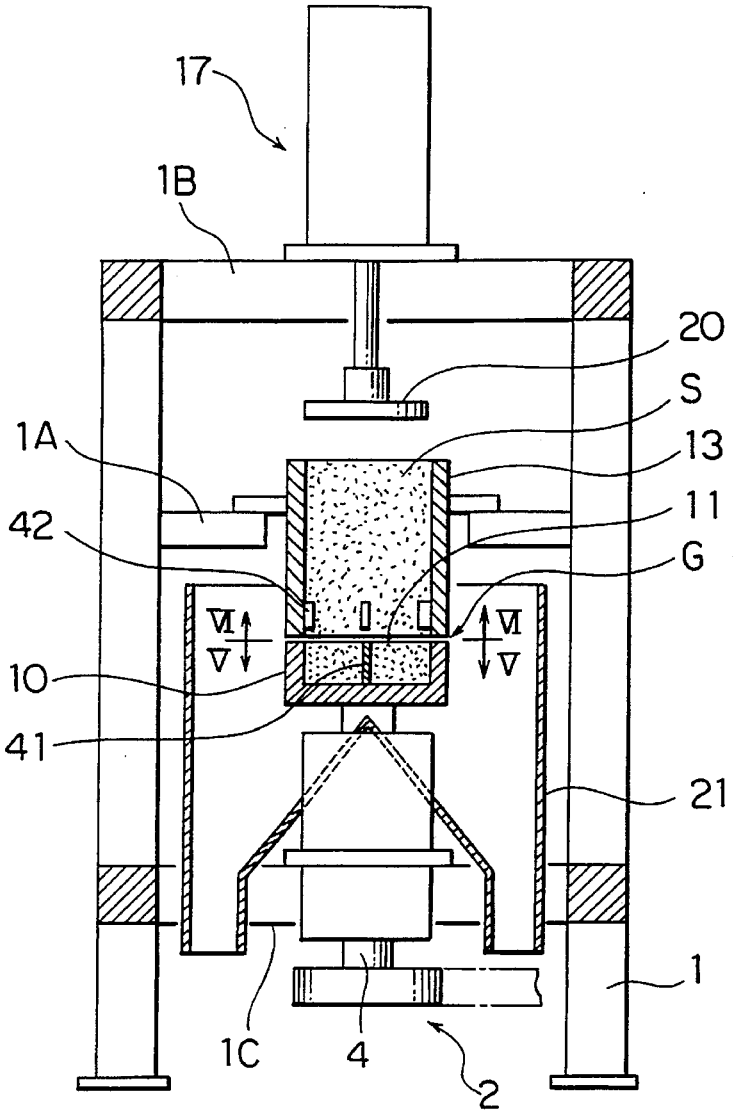
FIG. 4 is a partly sectional front view of a second embodiment of the apparatus of this invention.
Figure 5:
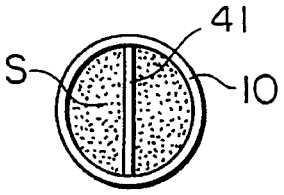
FIG. 5 is a plan view taken along line V—V in FIG. 4.
Figure 6:
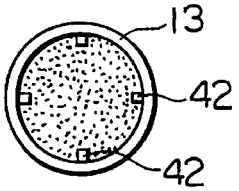
FIG. 6 is a plan view taken along line VI—VI in FIG. 4.
Figure 7:
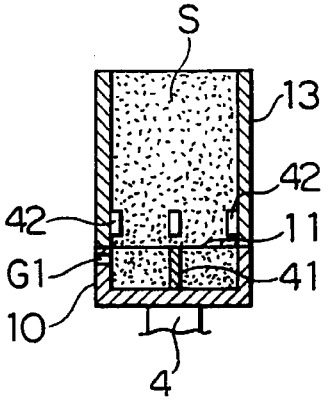
FIG. 7 is a sectional view of an alternative sand container and rotor of the apparatus of FIG. 4.
Figure 8:
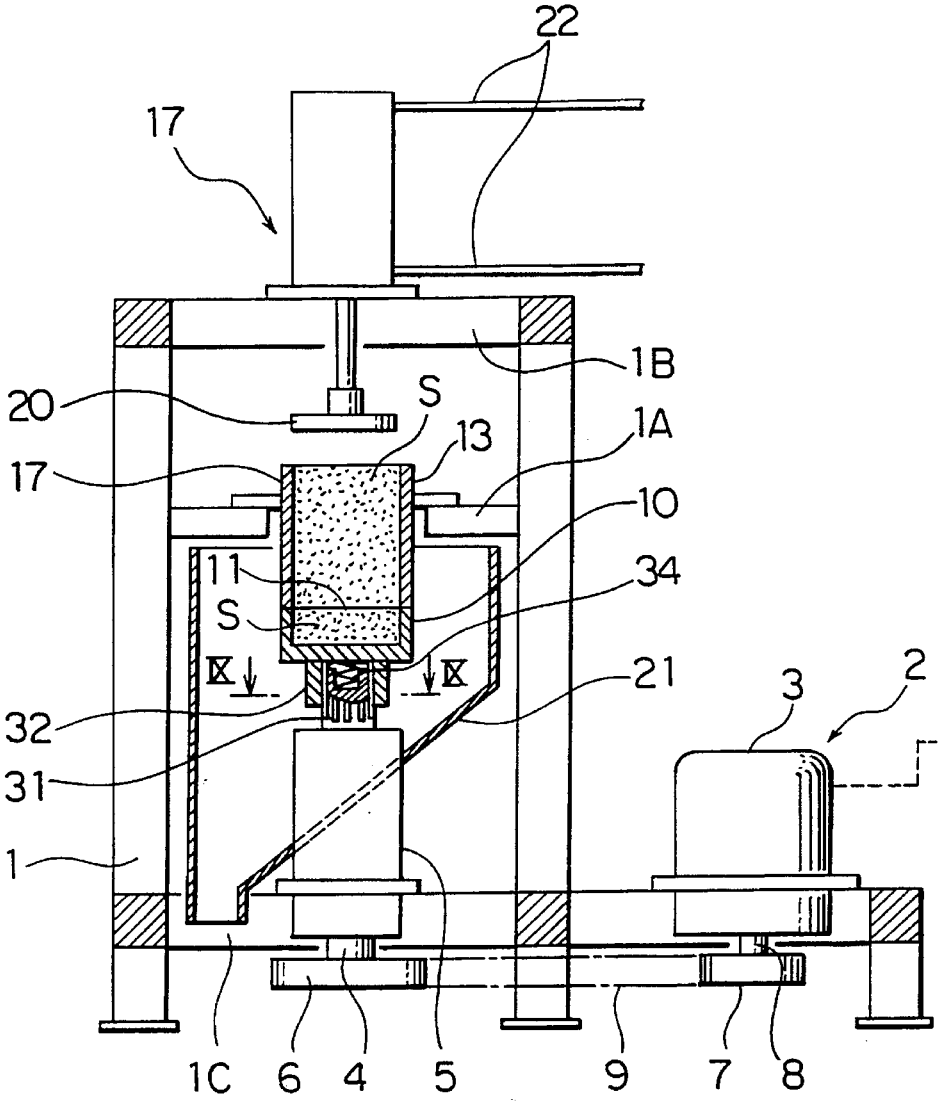
FIG. 8 is a partly sectional front view of a third embodiment of the apparatus of this invention.
Figure 9:
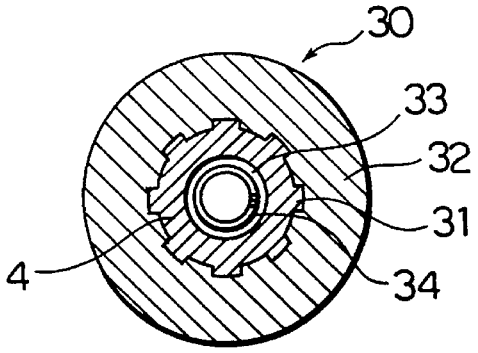
FIG. 9 is a cross-sectional view taken along line IX—IX in FIG. 8.
Figure 10:
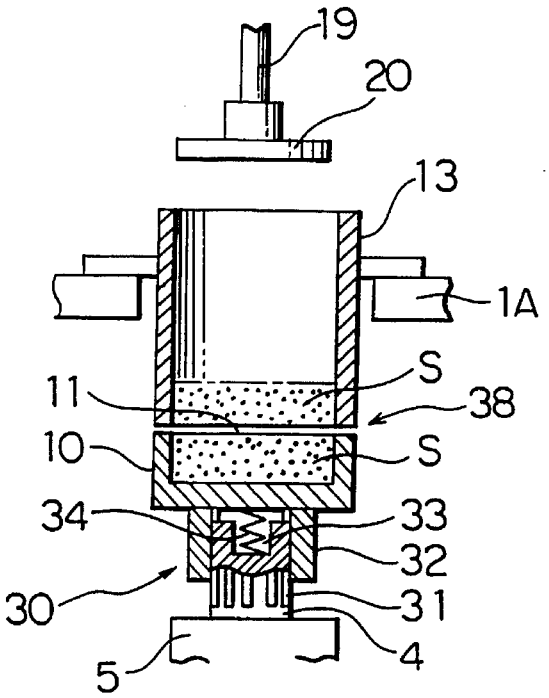
FIG. 10 is an explanatory drawing of the apparatus of FIGS. 8 and 9, showing used sand in a container not being pressed by pressing means.

As shown in FIG. 4, a gap, or slit, G is formed between the container 13 and the rotor 10 in the same way as in the first embodiment. However, this gap G may be eliminated, and one, or more than one, gap, or opening, G 1 is formed, as, for example, in the cylindrical wall of the rotor I 0, as shown in FIG. 7. The position of the gap G 1 should be adjacent to the surface 11 of the rotor to effectively discharge the processed sand.

FIGS. 8–11 show a third embodiment of the apparatus of this invention. The apparatus of this third embodiment is similar to that of the second embodiment. However, it differs in that the rotor 10 is connected to the rotary shaft 4 through connecting means 30 so that the rotor 10 can move vertically or towards and away from the container 13. As is clearly seen from FIG. 9, the connecting means 30 includes a spline connection consisting of a spline 31 formed on a distal, or upper, end of the shaft 4 and a spline nut 32, which at its upper end is fixedly mounted on the bottom of the rotor 10. The rotor 10 is mounted on the connecting means 30 so that the rotor 10 can move vertically. A coil spring 34 is disposed between the rotor 10 and the shaft 4. A substantial part of the coil spring 34 is disposed in a cavity 33 formed in the upper end of the shaft 4. Preferably, the coil spring 34 is one suitable to support the rotor 10, the spline nut 32, and the sand both in the container 13 and the rotor 10, and suitable so that a slit 38 of 0.1–0.5 mm is formed between the container 13 and the rotor 10.

Figure 11:
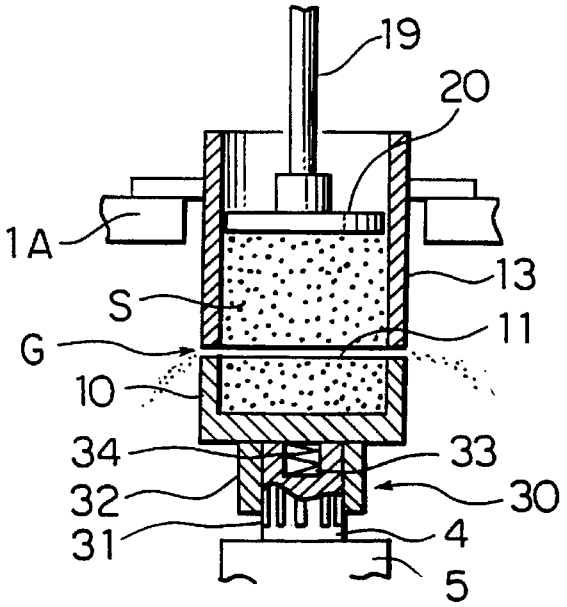
FIG. 11 is an explanatory drawing like FIG. 10, but showing the used sand in the container being pressed by the pressing means so as to process the used sand.

The means of FIG. 2 for controlling the pressure of the plate 20 is used in this embodiment. The pressing plate 20 may be lowered from a position shown in FIG. 10 to a desired position such as at the level of the lower end of the container 13 or a position slightly above the lower end. When the plate 20 is lowered to press the sand S in the container 13, the sand S in the container is pressed against the surface 11 of the sand in the rotor 10, thereby pushing the rotor 10 downwards. As a result, a gap G, which is greater than the slit 38, is formed between the container and the rotor while the coil spring 34 is contracted as shown in FIG. 11. The used sand both in the container and the rotor is abraded in the area at the surface 11, and the processed sand is discharged by the centrifugal force of the rotor from the gap G onto a chute 21.

After processing all or almost all of the sand S in the container 13, the piston rod 19 is raised, so that the rotor 10 comes back to its original position due to the action of the contracted coil spring 34.

In this third embodiment the coil spring 34 may be substituted for a pneumatic cylinder.

In FIGS. 12–15 a fourth embodiment of the apparatus of this invention is shown. The apparatus of this fourth embodiment is similar to that of the second embodiment. However, its structure differs in that annular grooves are formed in the outer parts of the container 13 and the rotor 10.

Figure 12:
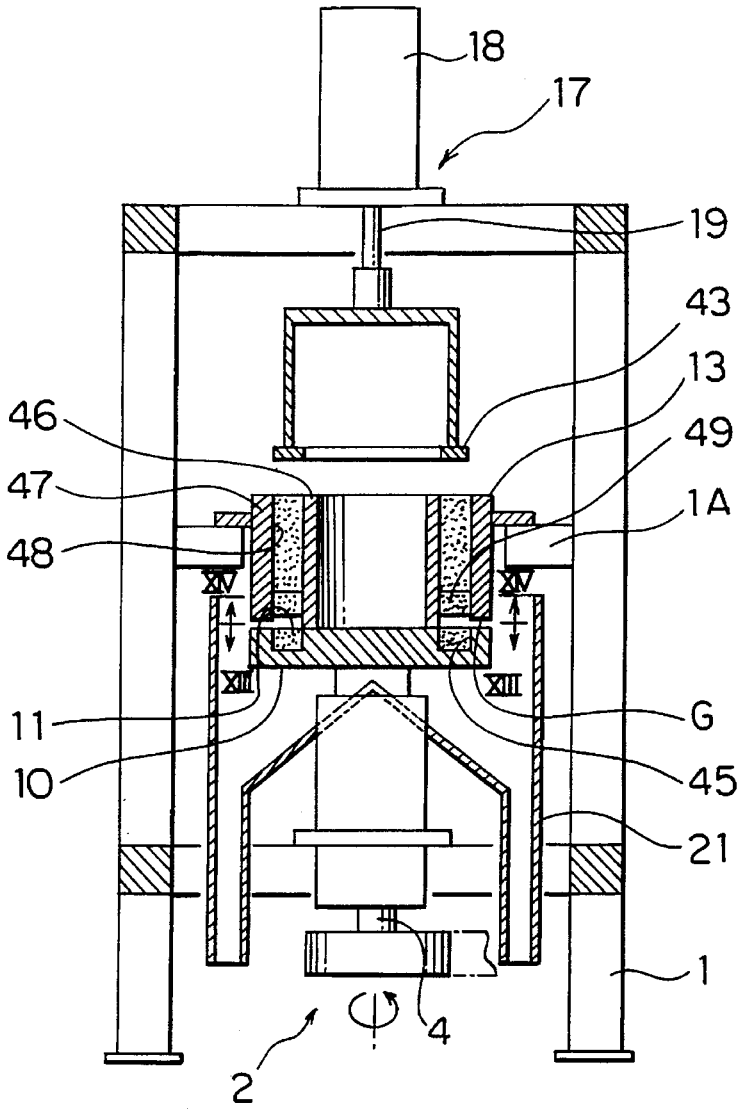
FIG. 12 is a partly sectional front view of a fourth embodiment of the apparatus of this invention.
Figure 13:
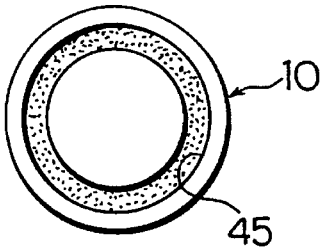
FIG. 13 is a plan view taken along line XIII—XIII in FIG. 12.
Figure 14:
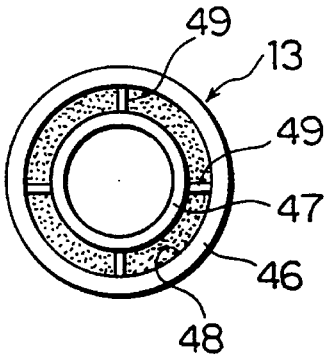
FIG. 14 is a plan view taken along line XIV—XIV in FIG. 12.

As shown in FIGS. 12 and 13, a rotor 10 at its outer part has an annular groove 45 to hold used sand. Similarly, as shown in FIGS. 12 and 14, a hollow-cylindrical container 13 holds used sand in a peripheral groove 48 formed between an inner cylindrical wall 46 and an outer cylindrical wall 47 of the container 13. The peripheral groove 48 of the container 13 faces the annular groove 45 of the rotor 10. The central part of the container 13 encircled by the inner wall 46 is empty, as shown in FIG. 12. However, it may be solid, if desired. The height of the outer cylindrical wall 47 is less than that of the inner cylindrical wall 46, so that the annular gap G may be formed between the outer wall 46 and the rotor 10. The lower end of the inner wall 46 may be in contact with an upper surface of the rotor 10. The gap G is disposed adjacent to the rotor surface 11 at which the sand in the annular groove 45 in the rotor 10 and the sand in the peripheral groove 48 in the container 13 contact each other. The outer wall 47 is connected to the inner wall by a plurality of connecting members 49.

When the rotor 10 is driven and a circular pressing plate 43 is lowered, the sand both in the container 13 and the rotor 10 are pressed and abrade each other at the surface 11, and the sand is discharged from the gap G onto a chute 21.

Figure 15:
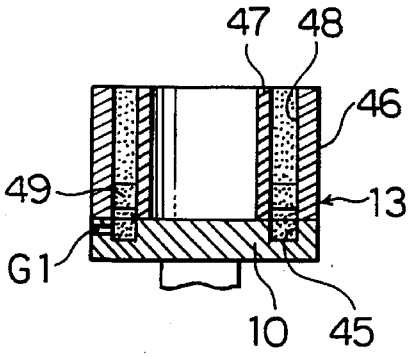
FIG. 15 is a sectional view of an alternative sand container and rotor of the apparatus of FIG. 12.

As shown in FIG. 15, the height of the outer wall 47 may be the same as that of the inner wall 46, so that the lower ends of both the inner and outer walls contact the rotor 10. In this case a gap, or opening, G 1 is formed in the outer part of the rotor 10 adjacent to the annular groove 45 to discharge the processed sand.

Figure 16:
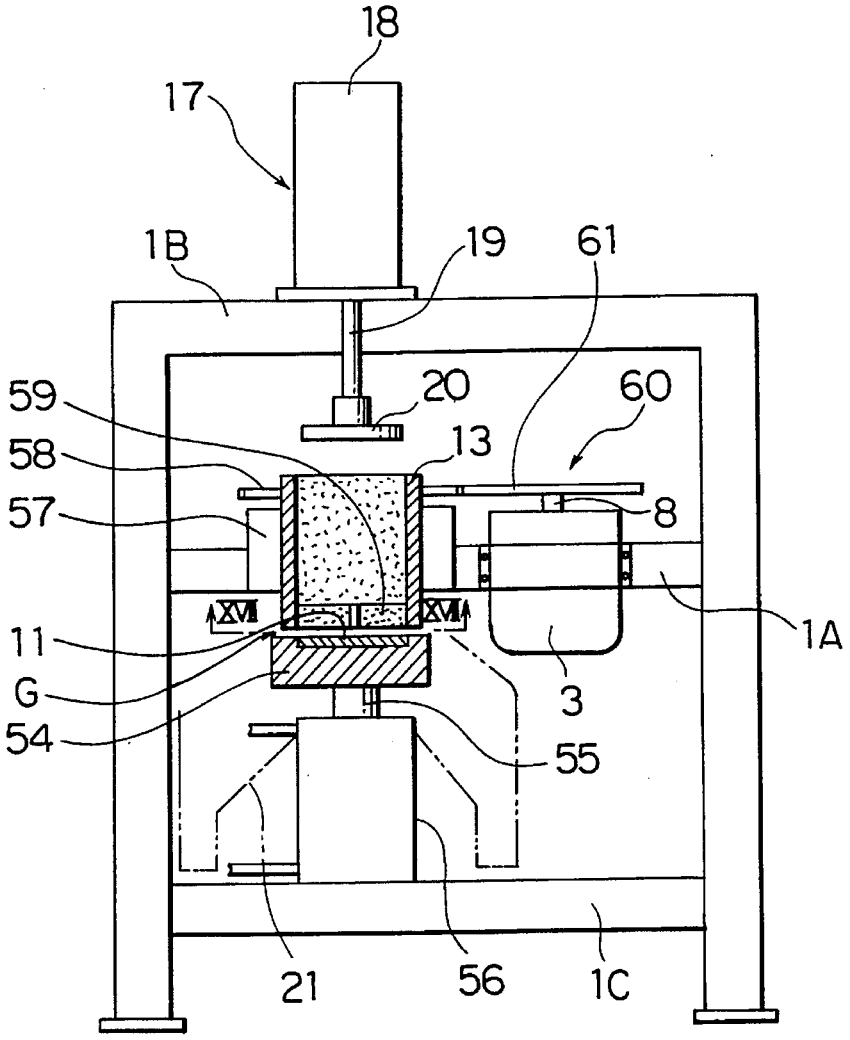
FIG. 16 is a partly sectional from view of a fifth embodiment of the apparatus of this invention, showing a sand container which is rotated by driving means.
Figure 17:
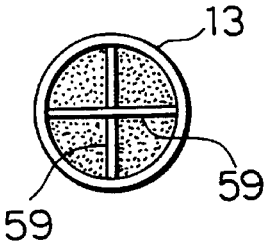
FIG. 17 is a bottom view of the rotor taken along line XVII—XVII in FIG. 16.

FIGS. 16 and 17 show a fifth embodiment of the apparatus of this invention. In this fifth embodiment a container to hold used sand is rotated by driving means relative to a member having a surface to contact the used sand in the container.

In FIG. 16 a member 54 is positioned at a desired level. The member 54 is secured to the piston rod 55 of a cylinder 56 which is mounted on a lower frame 1C of a frame 1. The member 54 can be in its normal position as shown in FIG. 16, but it may be lowered by activating the cylinder 56 when required for the maintenance of the member surface 11 and/or the member itself The member 54 cannot rotate.

A container 13 to hold used sand is rotatably mounted on an intermediate frame 1A of the frame 1 through a bearing 57. A toothed wheel 58 is fitted on the outer wall of the container 13. As shown in FIGS. 16 and 17, a plurality of plates 59 are disposed at the lower and inside part of the container 13. These plates 59 facilitate rotation of the sand in the container when it is rotated. Driving means 60 are also mounted on the intermediate frame 1A. The driving means include a motor 3 and a toothed flywheel 61 attached to the output shaft 8 of the motor 3. The toothed flywheel 61 meshes with the toothed wheel 58 attached to the container 13. The container 13 is positioned so that a gap G is formed between the lower end of the container 13 and the surface 11 of the member 54 when the member 54 is in its normal position. In the pressing means 17 of this embodiment a pressing plate 20 is rotatably attached to the piston rod 19 of the cylinder 18 through a bearing (not shown), so that the plate 20 rotates with the sand in the container 13 when it is driven by the driving means 60.

When the motor 3 is driven to rotate the container 13 together with the sand in it and when the pressing plate 20 is lowered to press the used sand in the container, the sand is pressed against the surface 11 of the member 54 under a constant pressure, and simultaneously it is abraded by the surface 11. The processed sand is discharged by the centrifugal force of the container from the gap G onto a chute 21.

This fifth embodiment is similar to the first embodiment. The main difference between the first and the fifth is as to which of the member 10, 54 or the container 13 is rotated.

One skilled in the art will appreciate that the present invention can be practiced by other than the described embodiments, which are presented for the purposes of illustration and not of limitation, and that the present invention is limited only by the claims that follow.

What we claim is:

1. An apparatus to remove adhering material from the surfaces of used sand to recycle the used sand, comprising:

a container for holding used sand, the container having a bottom opening;

pressing means for pressing the used sand in the container downwards;

a rotor disposed under the bottom opening of the container, the rotor having a surface which contacts the used sand in the container, wherein the rotor has an open cavity for containing used sand, and the rotor surface, which contacts the used sand in the container, is itself a surface of used sand in the rotor;

means for driving the rotor; and a gap disposed adjacent to the rotor surface so as to discharge processed sand.

2. An apparatus for removing adhering material from the surface of sand, comprising:

a container into which the sand may be placed having a bottom opening;

pressing means for pressing the sand which was placed in the container downwards;

a rotor disposed under the bottom opening of the container, said rotor further having an open cavity in which sand may be contained, wherein the open cavity is shaped such that sand contained in the open cavity of the rotor contacts the sand in the container; means for driving the rotor; and a gap disposed adjacent to the rotor surface so as to allow for the discharge of sand which has been processed by the apparatus.

3. The apparatus of claim 2, wherein a member for preventing the used sand in the rotor from rotating is disposed in the rotor.

4. The apparatus of claim 2, wherein a member for preventing the used sand in the container from rotating is disposed in the container.

5. The apparatus of claim 2, further comprising means to open and close the gap.

6. The apparatus of claim 2, wherein the means for driving the rotor include a motor, and the pressing means include a cylinder provided with a hydraulic circuit, and wherein the apparatus further includes:

a detector to detect one of a value of power and a current for the motor;

a pressure control valve to control an output of the cylinder of the hydraulic circuit; and an input/output controller electrically coupled to the detector and the pressure control valve, the input/output controller receiving a detected value from the detector as an input signal and transmitting to the pressure control valve an output signal that corresponds to a result of a calculation such that the detected value becomes a predetermined constant value.

7. The apparatus of claim 2, wherein the rotor and the means for driving the rotor are connected to each other by a spline connection and a spring is disposed between the rotor and the means for driving the rotor.

8. The apparatus of claim 7, wherein the gap is formed between the container and the rotor against a force of the spring when the pressing means push the rotor surface by pressing the used sand in the container.

9. The apparatus of claim 8, wherein a slit of 0.1–0.5 mm is formed between the container and the rotor before the pressing means press the used sand in the container.

10. The apparatus of claim 2, wherein container has a peripheral groove in which used sand is held.

11. An apparatus for removing adhering material from the surface of sand, comprising:

a container into which the sand may be placed having a bottom opening;

pressing means for pressing the sand which was placed in the container downwards including a cylinder provided with a hydraulic circuit having an output;

a rotor disposed under the bottom opening of the container;

means for driving the rotor including a motor;

a detector, which produces a detected value, to detect one of a power level and a current for the motor;

a pressure control valve to control the output of the hydraulic circuit;

an input/output controller which is coupled to the detector and the pressure control valve which receives the detected value from the detector as an input signal and transmits an output signal to the pressure control valve which corresponds to a result of calculation such that the detected value becomes a predetermined value; and a gap disposed adjacent to the rotor surface so as to allow for the discharge of sand which has been processed by the apparatus.

12. A method for mechanically removing material adhering to surfaces of used sand for recycling the used sand, comprising the steps of:

arranging a rotor having a surface under a container having a bottom opening, the container holding used sand therein so that the used sand in the container can contact the rotor surface;

arranging a gap adjacent to the rotor surface; feeding used sand to be processed into the container;

pressing the used sand in the container downwards, and at the same time driving the rotor so as to abrade the used sand by the rotor surface, wherein the rotor surface is a surface of the used sand held in the rotor, thereby removing material adhering to the used sand and discharging processed sand from the gap by a centrifugal force of the rotor.

* * * * *